US005149568A

United States Patent [19]

Beck

[11] Patent Number: 5,149,568

[45] Date of Patent: Sep. 22, 1992

[54] GLOW IN THE DARK ARTWORK

[76] Inventor: Michael P. Beck, 4048 Kristy Cir., Omaha, Nebr. 68112

[21] Appl. No.: 615,368

[22] Filed: Nov. 19, 1990

[51] Int. Cl.[5] ..... F21K 2/00

[52] U.S. Cl. ..... 428/14; 428/195; 428/690

[58] Field of Search ..... 428/13, 14, 187, 195, 428/690

[56] References Cited

U.S. PATENT DOCUMENTS

| | | | |
|---|---|---|---|
| 2,577,320 | 12/1951 | Fenyo | 428/13 X |
| 2,629,956 | 3/1953 | Switzer | 428/29 |
| 2,654,971 | 10/1953 | Harrison | 40/542 |
| 4,278,022 | 7/1981 | Fitzpatrick et al. | 428/187 X |
| 4,525,295 | 6/1985 | Lister | 252/301.36 |
| 4,708,817 | 11/1987 | Dudnick | 252/301.16 |
| 4,745,286 | 5/1988 | Jones | 40/542 X |
| 4,913,946 | 4/1990 | Sala et al. | 428/38 |

*Primary Examiner*—Henry F. Epstein
*Attorney, Agent, or Firm*—John A. Beehner

[57] ABSTRACT

Glow in the dark artwork which includes a luminescent layer formed of a luminescent material such as a fluorescent or phosphorescent paint or coated layer. The luminescent layer is secured with its luminescent surface covered by image means. The image means has an image formed on its surface via a plurality of image defining opaque and translucent areas. Opaque areas of the image means prevent photons emitted from the excited atoms of the luminescent material from passing through the opaque areas of the image means as light. Translucent areas of the image means allow photons emitted from the excited atoms of the luminescent material to pass through the translucent areas of the image means as light. In this way a glow in the dark image may be produced. Securement means is also provided for securing the luminescent layer to the image means.

10 Claims, 3 Drawing Sheets

GLOW IN THE DARK ARTWORK

BACKGROUND OF THE INVENTION

1. Technical Field

The present invention is directed to artwork images and the like and more particularly to glow in the dark artwork images produced from graphics art film or the like.

2. Description of the Prior Art

Many individuals adorn the walls of their businesses and homes with framed works of art. One artistic medium, used to produce images suitable for framing, is photographic or graphics art film. Such film contains small grains of silver bromide, evenly spread over a thin gelatin coating on a transparent surface. Light alters the silver bromide to produce light activated silver bromide:

$$AgBr + light \rightarrow AgBr^{light}$$

The film containing silver bromide that has been exposed to light ($AgBr^{light}$) may then be treated with a solution containing a mild reducing agent (developer). In the redox process that follows, the $Ag^{+}$ions in the activated AgBr are preferentially reduced to metallic silver particles. The number of black metallic silver particles formed on the film is directly proportional to the amount of light exposure received by each area of the film. In this way a negative image may be formed. Such images are typically used to produce a positive print. These prints may then be framed for display.

Color prints and transparencies may also be produced. In order to produce a color image a film coated with three emulsion layers (responding respectively to blue, green, and red light) is used. A yellow filter layer is interposed between the first layer (blue sensitive) and the remaining two layers (green and red) in 1#order to prevent the blue light from adulterating the green and red layers. The emulsion layers contain chemicals which form dyes after being exposed to light.

Positive prints or transparencies are made in a reversal. The film is first developed to produce a negative in all three layers. Once the film has been developed it is successively exposed to a blue, green, and red light source. After each of these exposures the film is redeveloped. The film is then bleached in order to produce a positive color print or transparency. Until now positive or negative film transparencies have not been associated with a luminescent layer.

Luminescence was first discovered by an alchemist in 1669. This process occurs when an atom of a luminescent material absorbs a photon of energy. This forces the atom into an excited state. As the atom moves from an intermediate energy state to its ground state a photon (having a lower energy and frequency than the absorbed atom) is emitted from the atom. There are two basic types of luminescent substances, namely, fluorescent and phosphorescent materials. Fluorescent materials emit visible light only after it has been bombarded with ultraviolet radiation. Phosphorescent materials continue to glow long after an illuminating source has been removed since excited phosphorous atoms may remain in a metastable state for several hours.

The process of forming glow in the dark images in also known in the art. For example, Switzer, U.S. Pat. No. 2,629,956 discloses a fluorescent printing method which utilizes novel fluorescent dyes applied so as to form an image on the viewing surface of a non-image producing substrate. Likewise, Dudnick, U.S. Pat. No. 4,708,817 discloses a method of forming latent luminescent image patterns on the viewing surface of a wide variety of substrates.

The resulting luminescent images produced by both the Switzer and Dudnick methods require the use of special luminescent materials adapted for use on particular types of substrates. Additionally, the luminescent images produced by these methods is applied primarily as paint in a luminescent image producing pattern on a particular medium, and only secondarily, if at all, as paint in a luminescent image producing pattern to luminesce an already image producing medium. Furthermore, both disclosures teach the application of a luminescent paint or dye to the front or viewed surface of a particular medium. Finally, neither Switzer nor Dudnick disclose the use of photographic film to produce glow in the dark transparencies.

3. Objects of the Invention

Therefore, it is a principal object of t present invention to provide improved glow in the dark artwork.

Another object of the present invention is to provide means of providing luminescence to existing artwork images.

Another object of the present invention is to provide black and white glow in the dark artwork from existing artwork images.

Another object of the present invention is to provide color glow in the dark artwork from existing artwork images.

Another object of the present invention is to produce luminescent images from existing black and white or color transparency images.

Another object of the present invention is to provide glow in the dark artwork which is economical to produce and widely adaptable for use in luminescing any image.

Another object of the present invention is to provide glow in the dark artwork which is attractive and refined in appearance.

Another object of the present invention is to provide glow in the dark artwork which is simple in construction and novel in appearance.

Finally, another object of the present invention is to provide a glow in the dark artwork which provides sufficient lumens for use as a light source and guide in low ambient light rooms such as children sleeping quarters and rest rooms. These and other objects will be apparent to those skilled in the art.

SUMMARY OF THE INVENTION

The present invention teaches the preparation and display of a novel glow in the dark object of art. The artwork includes a layer of a luminescent material such a fluorescent or phosphorescent paint or coated layer. The luminescent layer is secured so that its luminescent surface is adjacent to image means.

The image means provides an image formed on its surface via a plurality of image defining opaque and translucent areas. Opaque areas of the image means prevent photons emitted from the excited atoms of the luminescent material from passing through the opaque areas of the image means. Translucent areas of the image means allow photons emitted from the excited atoms of the luminescent material to pass through the translucent areas of the image means. The securement means may also be adapted for securing the luminescent layer and image means to a wall surface.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DESCRIPTION OF THE PREFERRED EMBODIMENT

Figure 1:
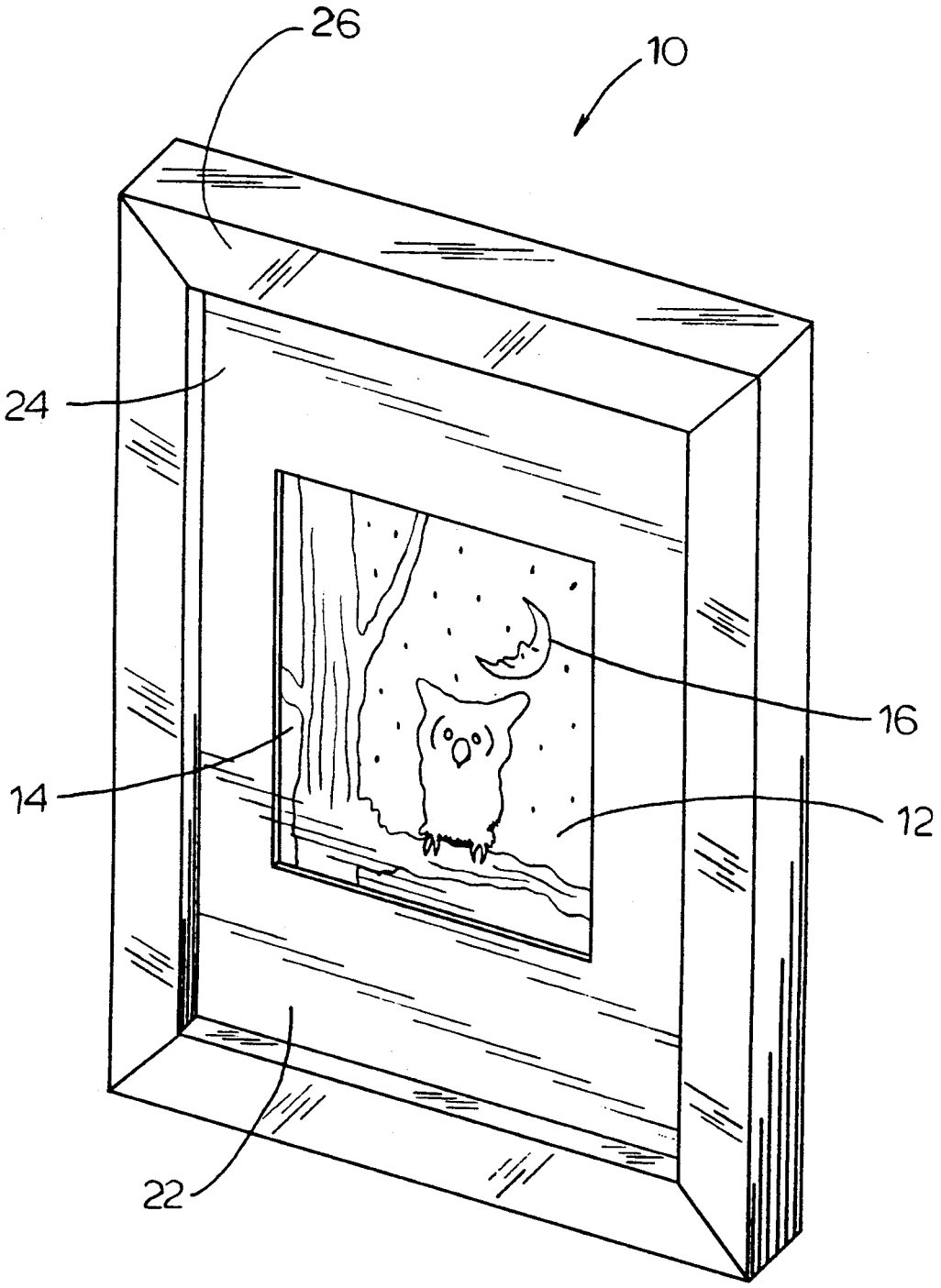
FIG. 1 is a perspective view of a preferred embodiment of the glow in the dark artwork secured within a conventional matted artwork frame.
Figure 2:
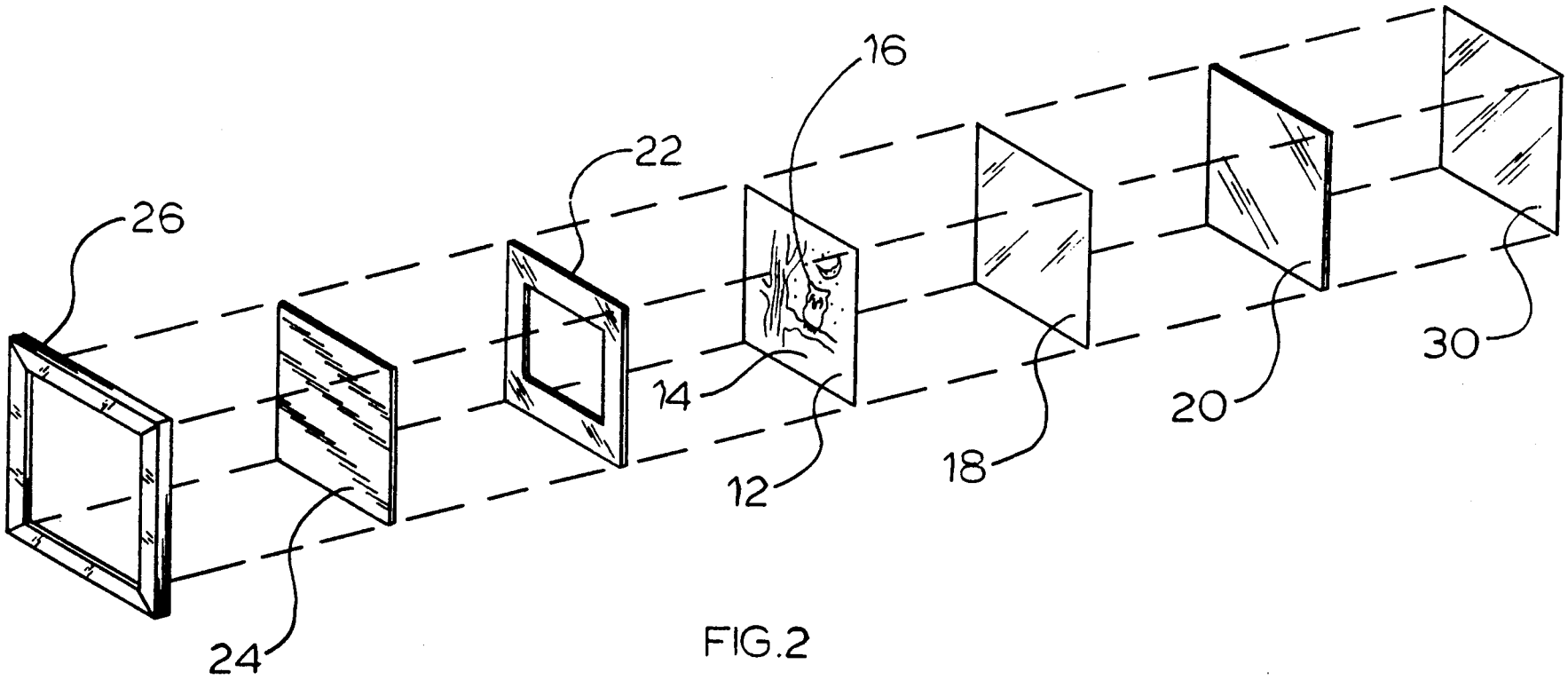
FIG. 2 is an exploded perspective view of a preferred embodiment of the glow in the dark artwork secured within a conventional matted artwork frame.
Figure 3:
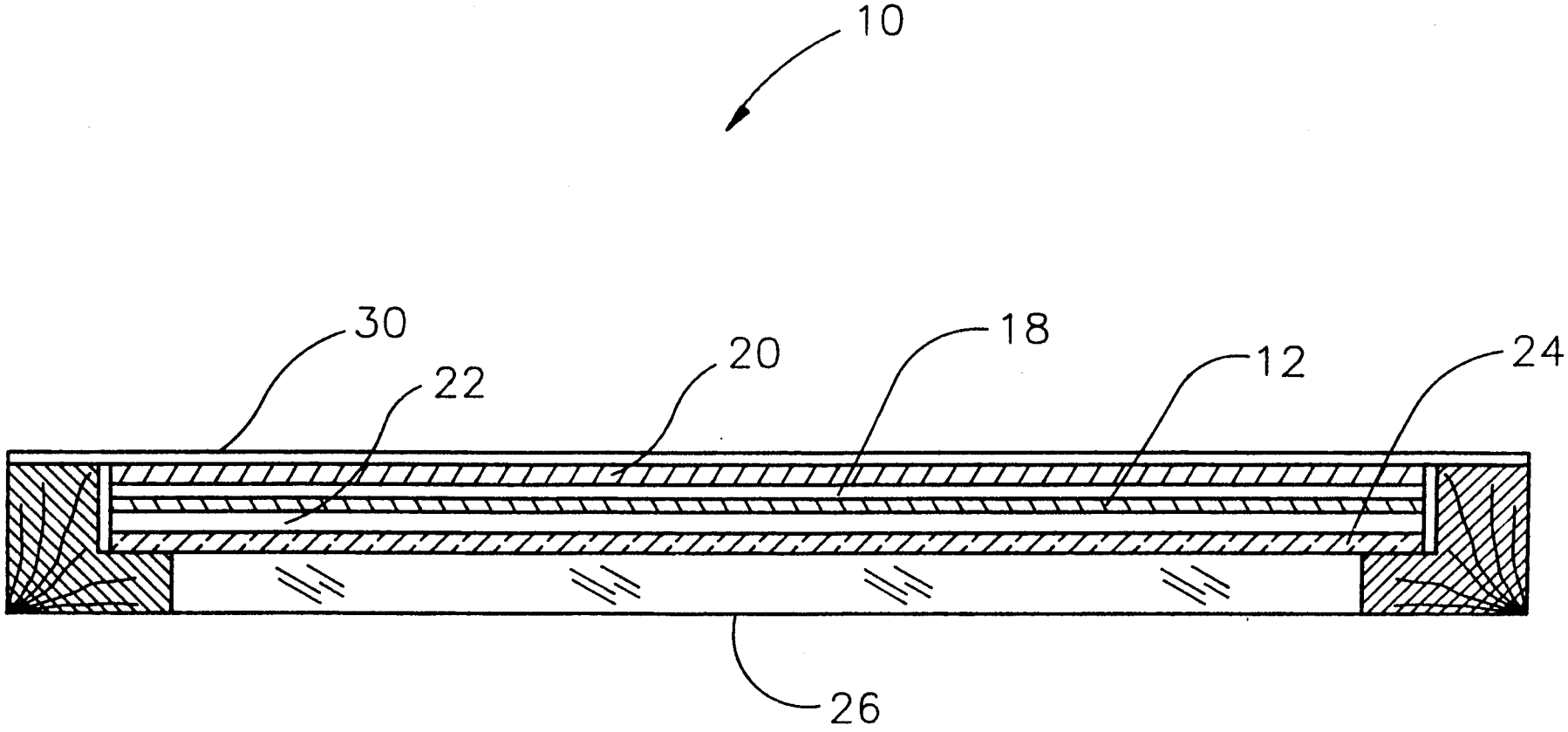
FIG. 3 is a top plan sectional view of a preferred embodiment of the glow in the dark artwork secured within a conventional matted artwork frame.

A preferred embodiment of the present invention 10 is illustrated in FIGS. 1 and 3.

Several image means may be utilized in practicing the invention set forth in the appended claims, however, in a preferred embodiment photographic film is employed. A black and white or color image, such as an ink drawing or painting, is photographed with a conventional 35 mm camera or the like loaded with LPD Film. This is usually accomplished by placing the image to be copied and camera in a copy stand.

Once exposed to the image the film is developed in a 1:1 ratio solution of Kodalith A and B. The developed film is then stopped, fixed, rinsed, and dried. In its final form the film produces a positive image. A slide is then fabricated from the film. Ortho Type 3 graphics art film is then cut to the desired dimensions and placed in the cropper of an enlarger. Ortho Type 3, and other graphic art films are available from Eastman Kodak ®, Co., Rochester, New York 14650. The slide is then used to expose the desired image onto the graphics art film.

The graphics art film is then developed to produce a negative image in a 1:1 ratio solution of Kodalith A and B. The Ortho film is then stopped, fixed, rinsed, and dried. In this fashion a crisp, negative, black and white image may be formed. The process for producing positive black and white or color images (14 or 16) will be apparent to those skilled in the art.

A luminescent layer 18 is then placed adjacent to the back surface of the graphics art film 12. This may be done according to several methods. In one method a luminescent spray paint may be applied directly to the back surface of the film 12. Likewise, the spray paint may be applied to the front surface of a sheet material having dimensions corresponding to the dimensions of the film 12. This sheet 18 may then be placed behind and adjacent to the film 12. In a preferred embodiment Dye-Namite TM radiance glow spray paint is used. This product is available from Carnival Arts, Inc., Mundelain, Illinois 60060.

The luminescent layer may also be painted on the back surface of the graphics art film 12 with a conventional paint brush. Haute-4-U TM is a phosphorescent acrylic color paint available in six colors from Carnival Arts. In another technique the brush on paint may be applied to the front surface of a sheet material having dimensions corresponding to the dimensions of the film 12. This sheet 18 may then be placed behind and adjacent to the film 12. Hi-Quanta luminescent paint available from Rexton ® International, Box 412, Collingswood, New Jersey 08108 also works well.

The luminescent layer may also be formed of Moonglow Tape, available from Porter Camera Store, Inc., Box 628, Cedar Falls Iowa 50613. This tape has an adhesive side covered by a calendar strip and a luminescing side. The calendar strip may be removed so that the tape may be adhered to a piece of card stock or the like in order to produce the luminescent layer 18. The graphics art film 12 may then be placed in front of and adjacent to the luminescent layer 18.

In order to display the artwork 10 a conventional frame 26 may be used. For example, a mat 22 may be placed over the front of the film 12. A sheet of non-reflective glass 24 may then be placed in the frame 26 and the mat 22, film 12, and luminescent layer 18 may then be placed behind the glass 24. A board 20 may be placed behind the film 18 and a sheet of durable paper 30 may finally be glued to the back of the frame 26 in order to secure the glass 24, mat 22, film 12, luminescent layer 18, and board 20 within the frame 26. Conventional frame hanging means may then be utilized to secure the glow in the dark artwork 10 to a wall.

In order to place children afraid of the dark at ease a plurality of framed glow in the dark artwork 10 images may be placed on the walls of such a child's room. During the day the artwork is visible in ambient light and photons from the sun or artificial light act to charge the luminescent layer 18. At night, when the room is otherwise dark, artwork images cast a cool and benevolent light over the room. This dispels a child's fear of the dark without unduly raising the light level of the room. Likewise, glow in the dark artwork 10 may be placed in rooms to guide those finding it necessary to rise during the night.

While the invention has been described with a certain degree of particularity, it is manifest that many changes may be made in the details of construction and the arrangement of components without departing from the spirit and scope of the disclosure. It is understood that the invention is not limited to the embodiments set forth herein for purposes of exemplification, but is to be limited only by the scope of the appended claims including the full range of equivalency to which each element thereof is entitled.

Thus, there has been shown and described an improved glow in the dark artwork which accomplishes at least all of the stated objects.

I claim:

1. A glow in the dark artwork, comprising:

a luminescent layer having front and back surfaces;

support means for supporting said luminescent layer; and an image layer including a plurality of image defining opaque and translucent areas, said image layer overlying the front surface of said luminescent layer and in adjacent relation thereto whereby upon exposure of said front surface of said luminescent layer to a light source said image means and luminescent layer produce an image visible in low ambient light.

2. The glow in the dark artwork of claim 1, wherein said luminescent layer comprises a fluorescent material layer.

3. The glow in the dark artwork of claim 2, wherein said fluorescent material layer comprises a sprayable paint coating at least one surface of said image means.

4. The glow in the dark artwork of claim 1, wherein said luminescent layer comprises a phosphorescent material layer.

5. The glow in the dark artwork of claim 4, wherein said phosphorescent material layer comprises a sprayable paint coating on the back surface of said image means.

6. The glow in the dark artwork of claim 1, wherein said support means comprises a conventional picture frame and its related matting and backing components.

7. The glow in the dark artwork of claim 1, wherein said image means comprises an image exposed onto at least one sheet of photographic film.

8. The glow in the dark artwork of claim 7, wherein said sheet of photographic film produces a negative black and white image when exposed to light.

9. The glow in the dark artwork of claim 7, wherein said sheet of photographic film produces a positive black and white image when exposed to light.

10. The glow in the dark artwork of claim 7, wherein said sheet of photographic film produces a positive color image when exposed to light.

* * * * *